United States Patent [19]

Tomida

[11] Patent Number: 4,669,219

[45] Date of Patent: Jun. 2, 1987

[54] LATERAL SLIDING SASH

[75] Inventor: Katsu A. Tomida, Matsudo, Japan

[73] Assignee: Ever Elegant Marketing Co., Ltd., Taipei, Taiwan

[21] Appl. No.: 847,368

[22] Filed: Apr. 2, 1986

[30] Foreign Application Priority Data

Nov. 15, 1985 [JP] Japan ..... 60-254679

[51] Int. Cl.[4] ..... E05D 15/20

[52] U.S. Cl. ..... 49/130

[58] Field of Search ..... 49/130, 129, 127

[56] References Cited

U.S. PATENT DOCUMENTS 3,841,024 10/1974 Cheng ..... 49/130

4,384,429 5/1983 Rokicki et al. ..... 49/130

4,551,945 11/1985 Von Resch ..... 49/130 X

*Primary Examiner*—Philip C. Kannan

*Attorney, Agent, or Firm*—Sughrue, Mion, Zinn, Macpeak and Seas

[57] ABSTRACT

A lateral sliding sash comprises a sash frame having upper and lower frame members and two upright frame members; a first sash piece slidably mounted on the sash frame; a second sash piece; two sets of sliding members slidably mounted on the lower and upper frame members, respectively, the sliding members of each set being separated a predetermined distance and capable of being moved together; and two sets of linkarms pivotally connected to the sets of sliding members at their one ends, and to the lower and upper surfaces of the second sash piece at their other ends, respectively. The linkarms of each set are parallel to each other, so that the second sash piece can be pushed to engage in the sash frame and in alignment with the first sash piece, and can be pulled to disengage from the sash frame by the movements of the sets of linkarms and slid laterally with the sets of sliding members along the lower and upper frame members.

4 Claims, 18 Drawing Figures

LATERAL SLIDING SASH

BACKGROUND OF THE INVENTION

The present invention relates to a lateral sliding sash (here the term "sash" is intended to encompass window and door to which this invention is applicable), and more particularly to a lateral sliding sash which allows the adjacent left and right sash pieces in the sash stile to be in alignment with each other when the sash is closed. Thus, the depth of the sash stile can be substantially the same as that of the sash piece, i.e. half that of the sash stile used in the conventional lateral sliding sash. Also, the sash pieces cover the lower sash stile to prevent any obstruction and dust from accumulating on the lower sash stile.

In the conventional lateral sliding sash, the sash pieces are mounted in the separated rails on the sash stile. Dust easily accumulates on the surface of the sash stile of the conventional lateral sliding sash. If dust and grime are allowed to accumulate on the rails then the opening or closing the sash will simply clamp the grime or obstructions between the lower sash stile and the bottom surface of the sash piece. Consequently, the movement of the sash piece is hindered, and the surface of the lower sash stile is damaged. In addition, when the rollers of the sash pieces pass over the obstruction, they are susceptible to damage and possible malfunction because of the conditions.

In particular, the lower sash stile of an aluminum window located near the sea will accumulate sand containing sea salt. This sand is difficult to remove. The damaged surface of the lower sash stile, mentioned above, will disrupt of the anodic oxidation film on the surface of the aluminum window, so that the aluminum substance is exposed. The salt ion will thus generate a chemical reaction with the aluminum ion. The resulting corrosion of the aluminum greatly reduces the durability of the aluminum window. Moreover, in snowy climates piled snow on the outer rail of the window will also hinder the movement of the sash pieces.

In order to prevent environmental noise and save energy, a variety of double-layered sashes are suggested to provide sound and thermal insulation. FIGS. 16 and 17 show two types of such double-layered sashes.

FIG. 16 shows a double-layered sash assembled with two single-layered two-piece lateral sliding windows parallel to one another. FIG. 17 shows a window assembled with inner and outer double-layered sashes in the same manner as the general single-layered window. The above windows still cannot avoid the problem of exposing the lower sash stile to the elements. Furthermore, the depth of the sash stile of such a window is equal to, or larger than, that of the wall, and therefore it is bulky when mounted in the wall. For solving this problem, the depth of the inner sash edge A is always increased a depth of d3, and the inner window surface is moved outwards from the inner wall surface B in order to moderate the oppressive feeling caused by lack of space. In many cases there is not sufficient space for the depth d3, thus the oppressive feeling cannot be avoided.

For thermal and sound insulation, the single-layered sash existing in the buiding is supposed to add a single-layered lateral sliding sash on the inner window edge C as shown in FIG. 18 to form a similar structure to that of FIG. 16. However, in this situation because the space for mounting inside the original sash is always insufficient, another window edge C′ must be added. The addition will project inwards from the wall surface and is not only bad-looking but also requires further additional construction.

In the conventional sash, see FIG. 17, both the left and right sash pieces are double-layered. The thickness of the air enclosed between the inner and outer glass layers of each sash piece is less than that of the sash shown in FIG. 16. Thus insulation against sound and temperature is minimal. That is to say, if the sealing structure around the sash pieces are the same, the sound and thermal insulation effect is in proportion to the thickness of the air layer between the inner and outer glass layers. This has been proven through experiment.

Although the air layer of thickness d2, shown in FIG. 17, increases the sound and thermal insulation effect, the entire depth of the sash is greatly increased resulting in an extremely awkward and disadvantageous mounting of the sash as described above. The thickness d2 of the air layer of the two-layered sash piece cannot be increased further, and thus its effectiveness is extremely limited.

Since double-layered sash piece is thicker than single-layered sash piece, the fluctuation d4 from the left sash piece to the right sash piece is greater. The sash of FIG. 17 will cause excessive shadows which affect its ornamental effect. To solve this problem, it has been suggested that a plurality of fixed, unmovable single-piece sashes be mounted on the same plane and several pivoted windows be arranged at specified places for ventilation. However, with this kind of pivoted window, it is difficult to construct a large saash piece, and when it is opened, the space in the room is adversely affected. Such design is inconvenient when taking the effective use of space into consideration.

SUMMARY OF THE INVENTION

The primary object of the present invention is to provide a lateral sliding sash which forms a plane when it is in a closed position. The depth of the sash is half that of the conventional sash, and the sash pieces of this sash cover the entire lower sash stile preventing the accumulation of any obstruction or dust.

In accordance with the present invention, a lateral sliding sash comprises a sash frame having an upper and a lower frame member and two upright frame members; a first sash piece slidably mounted on the sash frame; a second sash piece; two sets of sliding members slidably mounted on the lower and upper frame members, respectively, the sliding members of each set being separated a predetermined distance and capable of being moved together; and two sets of linkarms pivotally connected to the sets of sliding members at their one ends, and to the lower and upper surfaces of the second sash piece at their other ends, respectively. The linkarms of each set are parallel to each other, so that the second sash piece can be pushed to engage in the sash frame and in alignment with the first sash piece, and can be pulled to disengage from the sash frame by the movements of the sets of linkarms and slid laterally with the sets of sliding members along the lower and upper frame members.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENT

Figure 1:
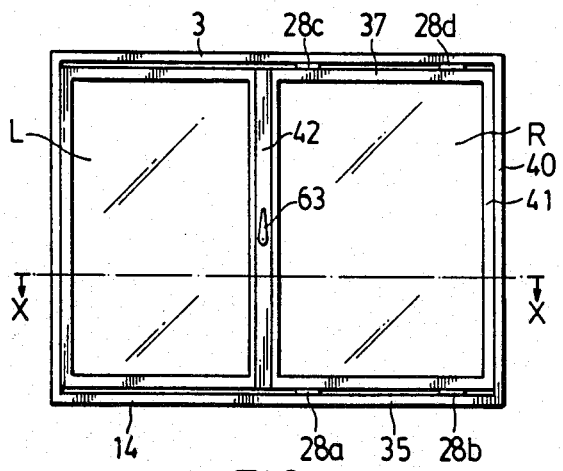
FIGS. 1, 3, and 5 are front elevational views of the lateral sliding sash in three different positions according to one preferred embodiment of the present invention.
Figure 2:
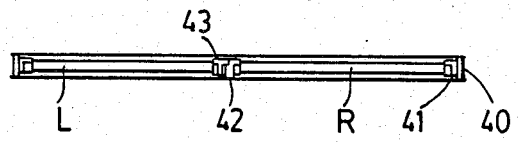
FIGS. 2, 4, and 6 are cross-sectional views of the lateral sliding sash taken along the lines X—X of FIGS. 1, 3, and 5 respectively.
Figure 3:
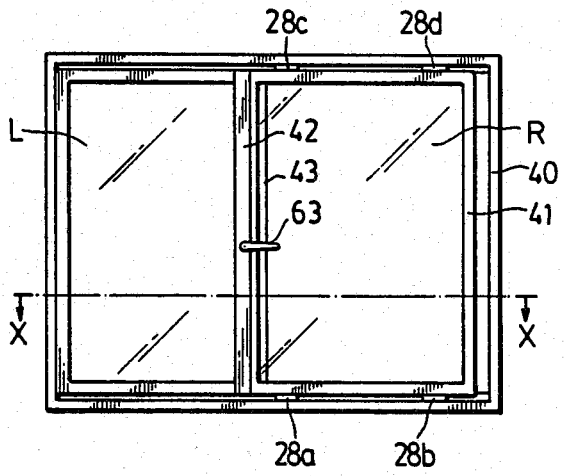
Figure 4:
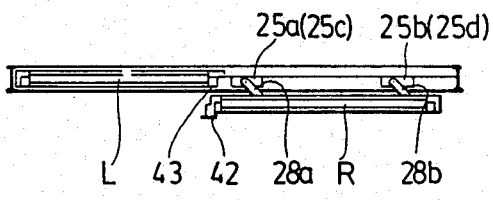
Figure 5:
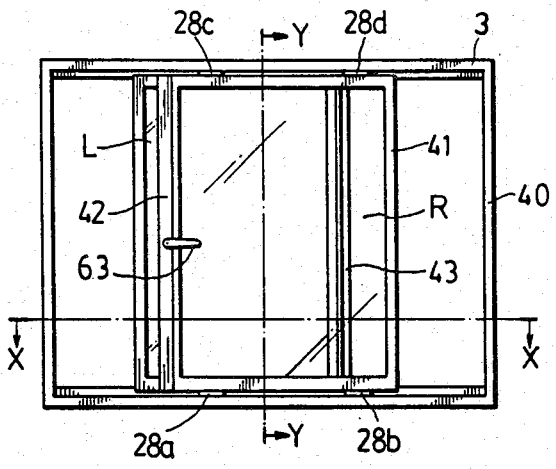
Figure 6:
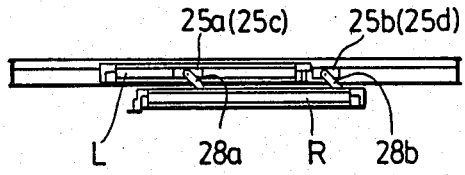

Referring now to the drawings, it should be noted that a like member is designated with a like reference number. FIGS. 1 and 2 show the left and right sash pieces L and R of the lateral sliding sash of the present invention in the closed position and in alignment with each other. FIGS. 3 and 4 show the lever handle 63 which is on the combined edge member 42 of the right sash piece R turned to the unlocked position allowing the right sash piece R to be pulled away from the sash frame and towards the interior of the room. Therefore it is moved to the left so that the combined edge member 42 is in front of the combined edge member 43 of the left sash piece L. FIGS. 5 and 6 show the right sash piece R moved further to the left, and the left sash piece L moved to the right, so that the pieces overlap in the center of the sash frame.

The right sash piece R is engaged pivotally with four linkarms 28*a*, 28*b*, 28*c*, and 28*d* arranged on the lower and upper sash frames 14 and 3 (which will be described later), so that the right sash piece R can either be engaged in or disengaged from the frame as desired by the movements of the linkarms. When the lever handle 63 is turned the right sash piece R can be pulled inwards to disengage from the frame and from its closed position and then moved to the left. At this time the left sash piece L can also be moved to the right to overlap with the right sash piece R.

A preferred embodiment of the sash structure, which performs the actions described above, will be described with reference to FIGS. 7 through 15 hereinafter.

Figure 7:
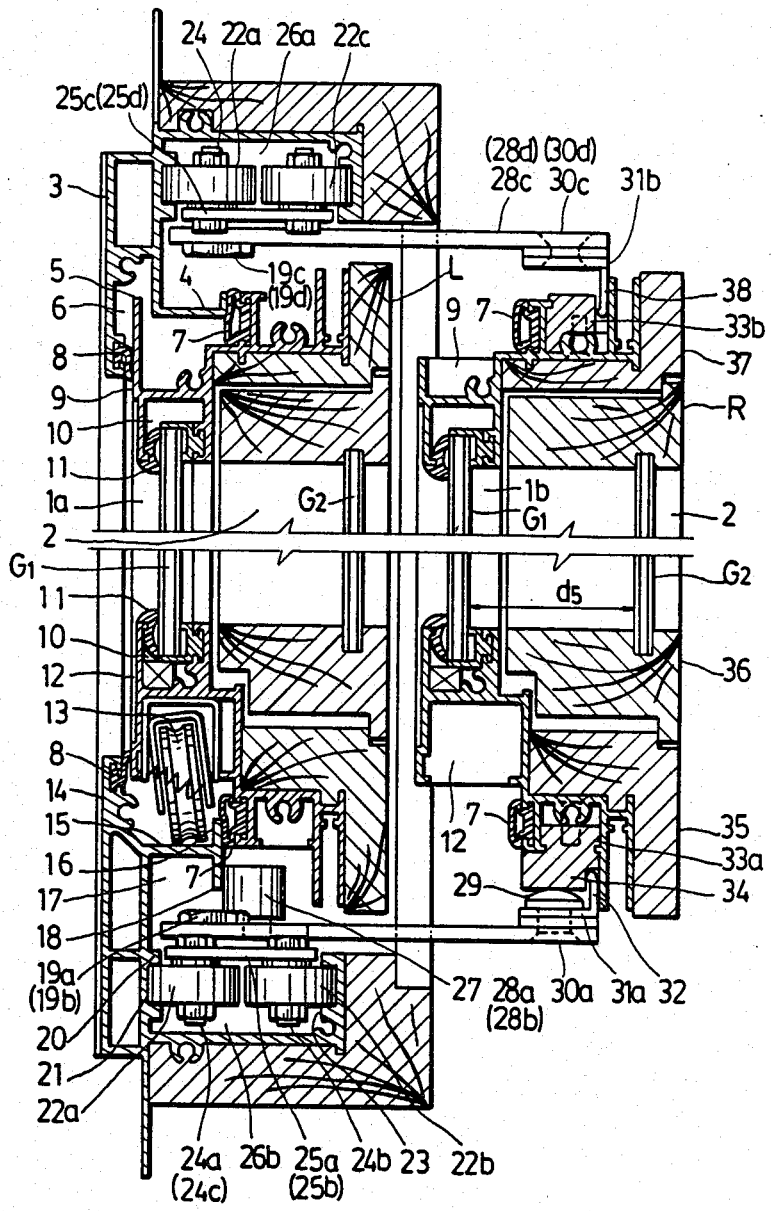
FIG. 7 is a cross-sectional view of the lateral sliding sash taken along the line Y—Y of FIG. 5, also illustrating the present invention in detail.

In FIG. 7 the left and right sash pieces L and R all consist of an outer sash part 1*a* or 1*b* and an inner sash part 2 to form an integral double-layered glass piece. For thermal insulation, the outer peripheral edge member of the outer sash part 1*a* or 1*b* is made of aluminum. Its inner peripheral edge member is made of wood, and is formed together with the outer peripheral edge member. The inner sash part 2 has a wooden peripheral edge member, and the glass G2 is mounted in it. The upper and lower edge members 9 and 12 of the outer sash part each have a glass groove 10, and the glass G1 is mounted in the groove 10 by the glass bead 11. The upper frame projection 4 and lower frame projection 16 can press the air-tight material 7 to abut against the edges of the upper and lower edge members 9 and 12 respectively.

The upper and lower frames 3 and 14 are also integrally formed with aluminum and wood in the same manner as the outer sash part, and have receiving chambers 26*a*, 26*b* respectively. The sliding members 25*a* and 25*c*, which support the right sash piece R fit into the receiving chambers 26*b* and 26*a* respectively, and can be slid laterally along the frames 14 and 3.

The wheels 22*a* and 22*b* are provided with the thrust bearings which are capable of withstanding the thrust loads. They are arranged on the sliding members 25*a* and 25*c* on the axes 24*a* and 24*b*. The wheels 22 can be rotatably fitted in the guide grooves 21 of the receiving chambers 26*a* and 26*b*.

The linkarms 28*a* and 28*c* are pivotally connected to the sliding members 25*a* and 25*c* at one end and to the coupled rods 31*a* and 31*b* at the other by pivot pins 30*a* and 30*c* respectively. Two resin blocks 33*a*, 33*b* are secured to the lower and upper portions 35 and 37 of the outer sash parts respectively, and are engaged with the coupled rod 31*a*, 31*b*. The resin blocks 33*a* on the lower portion 37 are secured above the pivot pin heads 29. Both resin blocks 33*a* and 33*b* have a protursion 34 (shown in FIG. 9 and described in detail below) capable of engaging in one recess 53 of the angle blade 32 of the coupled rod 31*a*, 31*b*. In this way, the resin blocks 33*a*, 33*b* are prevented from any lateral movement when the right sash piece R is pulled laterally. This will be described below.

The right sash piece R is supported by the linkarms 28*a* and 28*b*, and is prevented from slanting forwards of backwards of the angle blade 38 provided on the top portion. Thus the right sash piece R maintains a vertical position at all times.

When the right sash piece R is disengaged from the frame, its weight presses on the linkarms 28*a* and 28*c*. The wheels 22*b* withstand a downward force while the wheels 22*a* withstand an upward force due to the leverage. The upper and lower edges of the wheels 22*a* are supported by the upper and lower jaw members 20*a* and 23 respectively, allowing horizontal movement of the sliding members 25*a* and 25*c*.

A guide roller 27 made of resin is pivotally connected to the linkarm 28*a*. When the sash is in an opened position, the guide roller 27 will inhibit the linkarm 28*a* from returning to its closed position by itself. This also will be described in detail below. When the right sash piece R is pulled inward to the positions shown in FIGS. 4 and 7, a return torque acts on the linkarm 28*a*, so that it tends to return back to the closed position. This tendency is hindered by the guide roller 27 abutting against the projecting plate 18 extending downwards. The guide roller 27 rolls along the projecting plate 18 when the linkarm 28*a* and the sliding member 25*b* moves laterally.

When the right sash piece R is moved to the right to a predetermined position near the closed position, the guide roller 27 reaches the recess 66 of the projecting plate 18 (see FIG. 15) and is received in a chamber 17 to release the return inhibition of the linkarm 28*a*. In this situation, the right sash piece R can be pushed outwards to engage with the frame by the movements of the linkarms 28*a*, 28*c*.

Two wheels 13 are arranged on the lower edge member 12 of the outer sash part of the left sash piece L, and are rotatably located upon the roof wall 15 of the chamber 17. The upper fin 5 of the outer sash part is movably engaged with a guiding groove 6 of the upper frame 3, so that the left sash piece L can be moved laterally along the lower frame 14.

When the left sash piece L is closed, it presses the sash frame, and the air-tight material 7 abuts against the upper frame projection 4 while the T-shaped lower frame projection 16 extends from the roof wall 15. In addition, an air-tight material 8 is provided around the outer peripheral surfaces of the sash pieces to form a second seal. Each wheel 13 has a conventional slanting device to urge the left sash piece L to move slightly inwards when the left sash piece L is moved laterally. In this way, the air-tight material 7 separates from the sash frame, and therefore the friction force between them is released so that the sash piece can slide easily.

Figure 8:
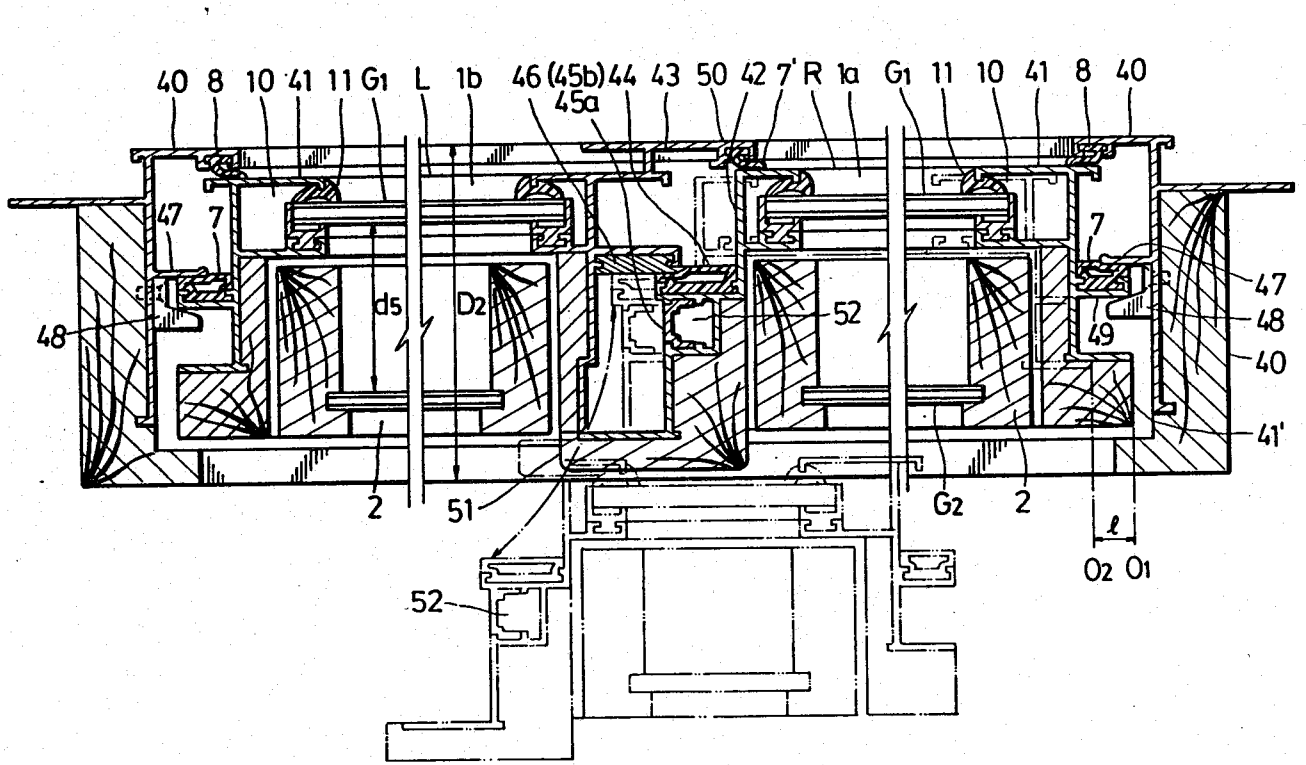
FIG. 8 is a cross-sectional view of the lateral sliding sash taken along the line X—X of FIG. 1, also illustrating the present invention structure in detail.

Referring to FIG. 8, the reference number 41 represents the upright edge members of the outer sash parts, and the reference numbers 43 and 42 represent the respective combined edge members of the left and right sash pieces, which can be combined to form the central pillar of the sash. The edge members 41, 42 and 43 all have glass grooves 10, and the glass G1 is mounted in them by the glass bead 11.

The air-tight materials 7, 44 and 46 are arranged on the same plane along the peripheries of the edge members 41, 42 and 43 respectively. The air-tight material 7 is pressed by the sash frame projection 47, and the upright edge members 41 abut against the air-tight material 8 along the upright sash frames 40 to maintain the double-seal.

The respective flanges 50 and 51 of the combined edge members 42 and 43 extend in opposite directions and along opposite sides. A air tight material 7' is arranged on the flange 50 of the left combined edge member 43, and is pressed by the right combined edge member 42. The air tight materials 46 and 44, respectively, on the left and right combined edge members 43 and 42 push against each other.

Two locking rods **45*a* and 45*b* can be slid within the guide groove 52 of the right combined edge member 42, and are connected to the lever handle 63 set in the right combined edge member 42. The locking rods 45*a* and 45*b*** can be moved to engage or disengage the sash frame.

Figure 9:
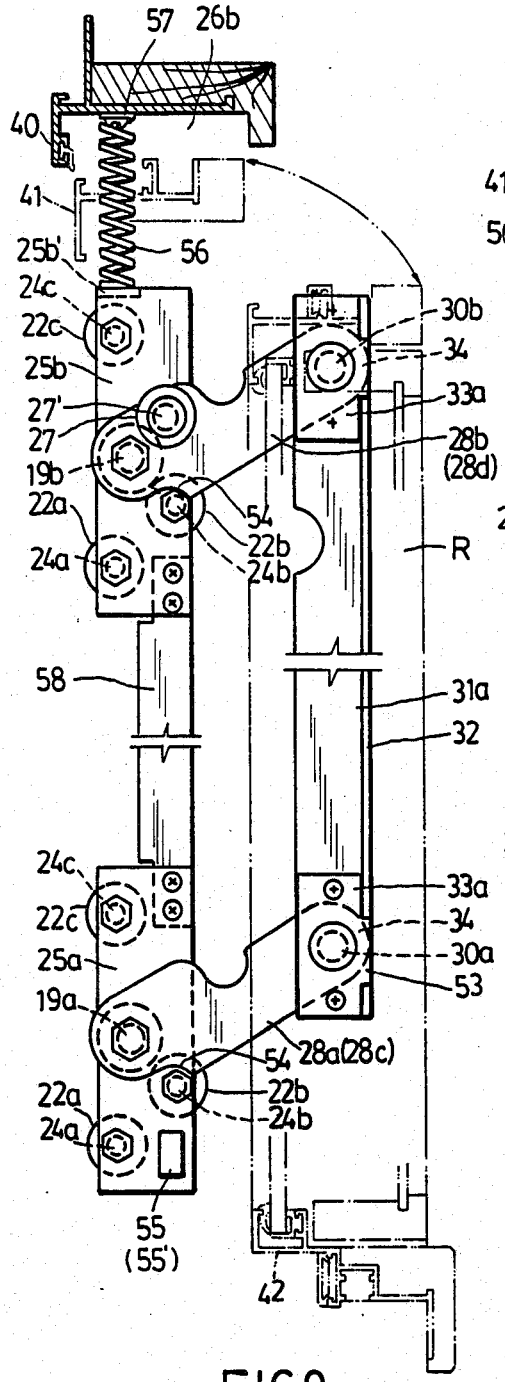
FIGS. 9 and 10 are top plan views of a driving mechanism of the lateral sliding sash.

With reference to FIG. 9, both sliding members **25*a* and 25*b* include three axes 24*a*, 24*b*, and 24*c* arranged in a triangle shape, and three wheels 22*a*, 22*b*, and 22*c* rotatably mounted about the axes 24*a*, 24*b*, and 24*c* respectively. The sliding members are pivotally connected to one ends of the linkarms 28*a* and 28*b* respectively by two pins 19*a* and 19*b*.** The pin attachment is located within the triangular shape formed by the axes.

A coupled rod 58 is secured to the sliding members **25*a* and 25*b* to keep them separate by a predetermined distance. The other ends of the linkarms 28*a* and 28*b* are pivotally connected to the coupled rod 31*a* by two pivot pins 30*a* and 30*b*. The distance between the pivot pins 30*a* and 30*b* is the same as that between the pins 19*a* and 19*b*. Thus, the pins 30*a*, 30*b*, 19*a* and 19*b*** can form a rhomboid shape at all times.

The coupled rod **31*a* has an upward extending angle blade with two recesses 53. The protrusions 34 of the resin blocks 33*a* are capable of being engaged and disengaged with the recesses 53 respectively. The right sash piece R is positioned on the linkarms 28*a* and 28*b*. When the right sash piece Ris pulled laterally, the protrusions 34 engage with the recesses 53 so that the right sash piece R is prevented from sliding laterally on the coupled rod 31*a*.**

Each linkarm **28*a*, 28*b* has a retaining recess 54 which abuts against the axis 24*b* to prevent the linkarms from rotating inwards beyond a predetermined angle. The resin guide roller 27 is pivotally connected to the linkarm 28*b* by a pivot pin 27', and abuts against the projecting plate 18 to prevent the linkarm 28*b*** from returning back to the close position by itself.

A coil spring 56 is secured to the lower portion of the upright sash frame 40 at one end by a screw 57, while its free end extends into the receiving chamber **26*b*** of the lower sash frame.

Figure 15:
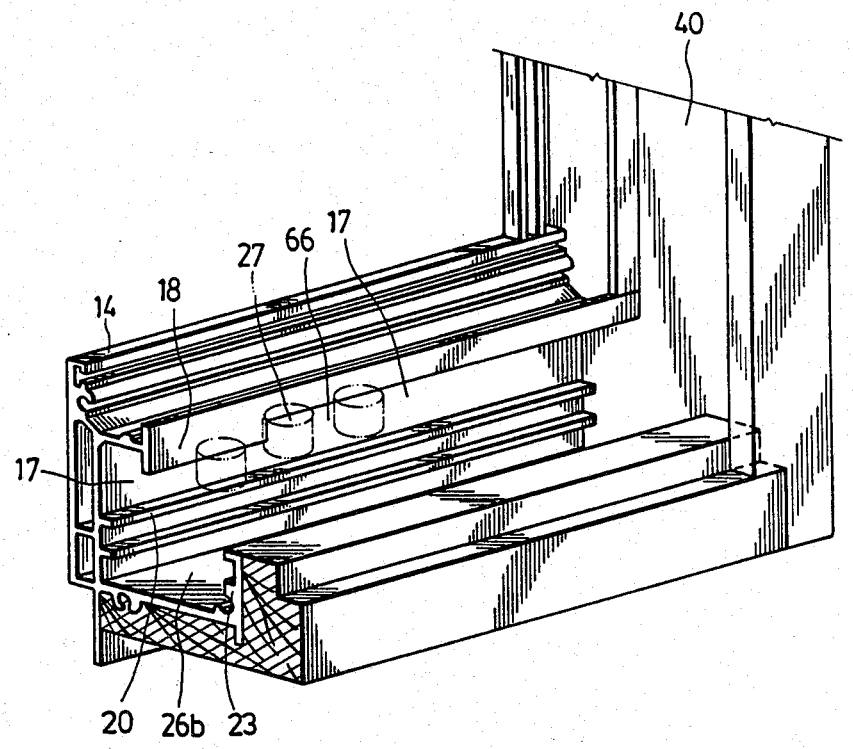
FIG. 15 is a fragmented perspective view of a lower sash frame with parts moved away for clarity.
Figure 16:
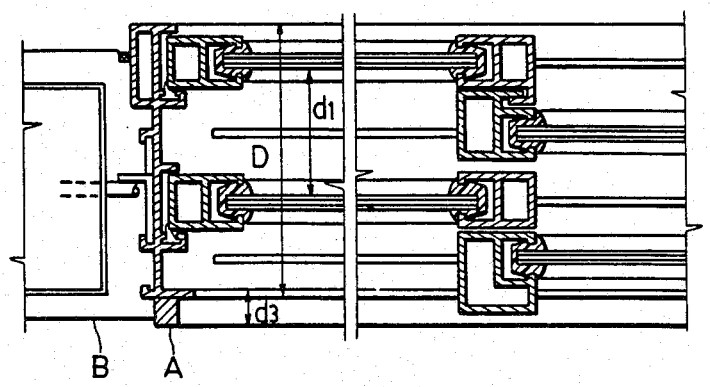
FIG.16 (PRIOR ART)
FIGS. 16, 17 and 18 are three cross-sectional views of three different types of conventional lateral sliding sashes.
Figure 17:
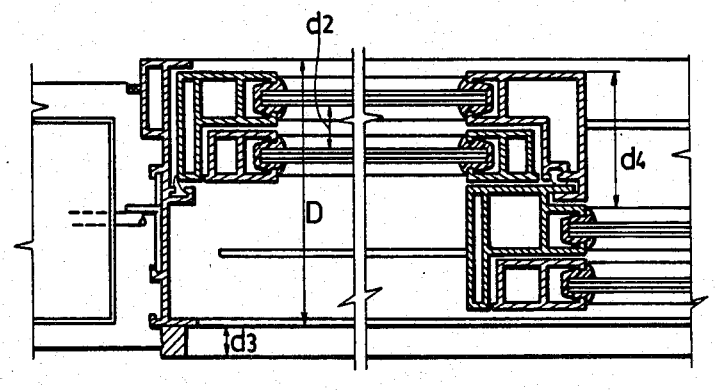
FIG.17 (PRIOR ART)
Figure 18:
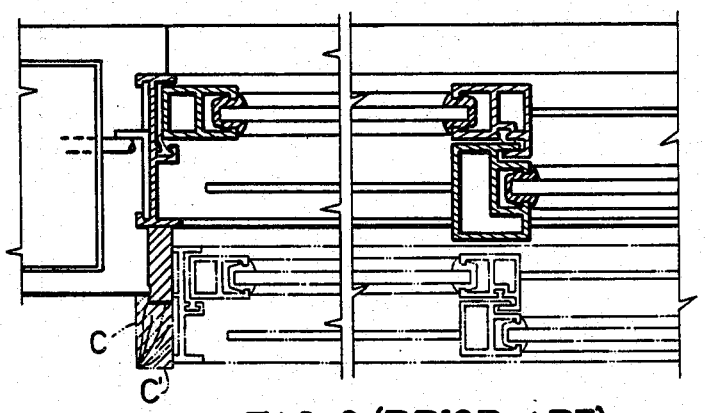
FIG.18 (PRIOR ART)

When the right sash piece R is moved to the right, the guide roller 27 is rotated along the projecting plate 18. since the movements of the linkarms **28*a*, 28*b* are limited, the sash piece R moves parallel to the sash frame by means of the sliding members 25*a* and 25*b*. When the sliding member 25*b* reaches a predetermined position, the downward flange 25'*b* touches the free end of the coil spring 56, and the guide roller 27 reaches the recess 66 of the projecting plate 18, as illustrated in FIG. 15**.

In this case, when the sash piece R is pulled further towards the upright sash frame 40, the coil spring 56 limits the sliding member **25*b* from moving with a force, and the guide roller 27 moves into the recess 66 so that the linkarm 28*b* can be rotated. Also, the linkarm 28*a* is rotated by the coupled rod 31*b*** so that the right sash piece R is ready to be pushed into the sash frame.

If the sash piece R is pushed further towards the upright sash frame 40 when its upright edge member 41' reaches a position 02 shown in FIG. 8, the sliding member **25*b* will press the coil spring 56, and the projecting wall 49 of the upright edge member 41' will move along the resin detent 48 secured on the sash frame 40, and will then be engaged, i.e. the right upright edge member 41 is locked. In this case, since the pins 30*a*, 30*b* have been pushed to the right and the pins 19*a*, 19*b* have been pushed to the left, the rhomboid formed by the pins 30*a*, 30*b*, 19*a* and 19*b*** is slimmer.

The upper sash portion 37 is connected to the linkarms **28*c*, 28*d* through the coupled rod 31*b*, while the linkarms 28*c*, 28*d* are pivotally connected to the sliding members 25*c*, 25*d* at their other ends. The sliding members 25*c*, 25*d* are arranged on the upper sash frame 3, and are symmetric with the sliding members 25*a*, 25*b*. The linkarms 28*a* to 28*d* can be rotated at the same angle as long as the rectangular shape formed by the pins 30*a* to 30*d* is not changed, i.e. the right sash piece R is not changed to a rhomboid shape. Therefore, the sash piece R maintains a vertical position to engage or disengage with the sash frame. Also, the air tight materials 7, 46, and 8** are snugly and effectively pressed.

Figure 13:
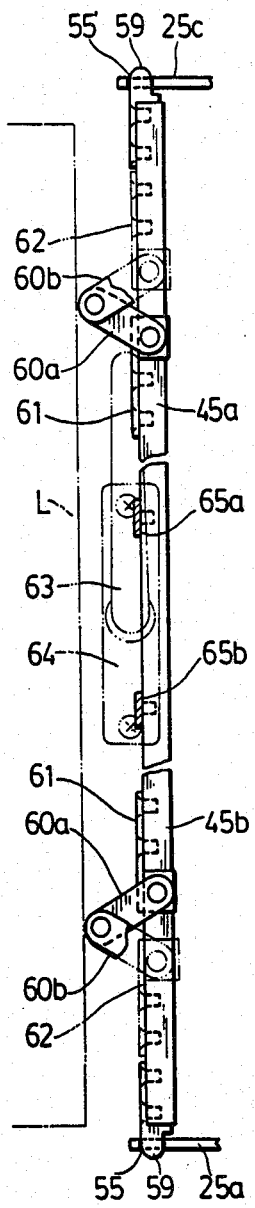
FIGS. 13 and 14 are front elevational views of a locking device of the lateral sliding sash.

Referring now to FIG. 13, showing a locking device in the combined central pillar. The locking rods **45*a*, 45*b* have a resin terminal 59 fastened to their upper and lower ends respectively. The terminals can be moved to project from the upper and lower surfaces of the sash piece to engage with the terminal receiving holes 55, 55' on the sliding members 25*a*, 25*c* by the locking rods 45*a*, 45*b*.**

In the upper part of the locking device, two linkarms **60*a* and 60*b* are pivotally connected to each other at one ends, and to two brackets 61 and 62 respectively at other ends. The bracket 61 is secured to the locking rod 45*a*, while the bracket 62 is secured to the combined edge member 42. The structure of the lower part of the locking device is the same as that of the upper part, the only difference is that the bracket 61 is secured to the locking rod 45***b*. When the locking rods 45*a*, 45*b* are slid upwards and downwards or vice versa, the linkarms 60*a*, 60*b* are bent or stretched accordingly.

The locking rods 45*a* and 45*b* are moved in opposite directions by the rotation of the lever handle 63. When the linkarms 60*a* and 60*b* are bent, the linkarms 60*a* will abut against the left combined edge member 43. The length of the linkarm 60*a* is selected so that the preceding action will urge the right sash piece R to the right by a predetermined distance 1. Thus, the coil spring 56 is pressed the distance 1.

Two levers 65*a* and 65*b* extending from the lever handle base 64 are fastened to the locking rods 45*a* and 45*b* respectively. The lever handle base 64 is connected with rack and pinion mechanism therein, which changes the rotation of the lever handle 63 into a linear movement. When the lever handle 63 is rotated, the levers 65*a* and 65*b*, and the locking rods 45*a* and 45*b* are slid in opposite directions.

Figure 11:
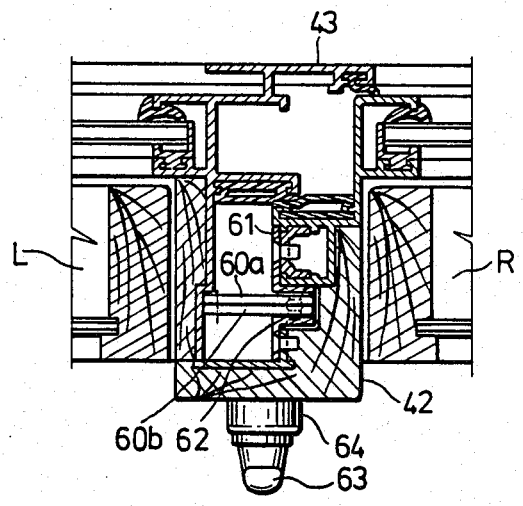
FIGS. 11 and 12 are cross-sectional views of the central combined pillar of the lateral sliding sash.
Figure 12:
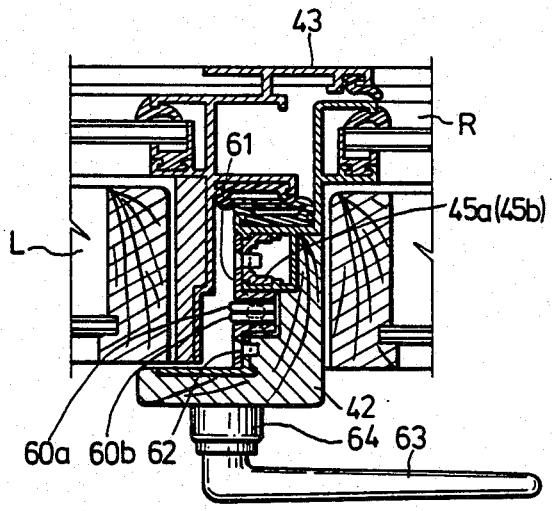
Figure 14:
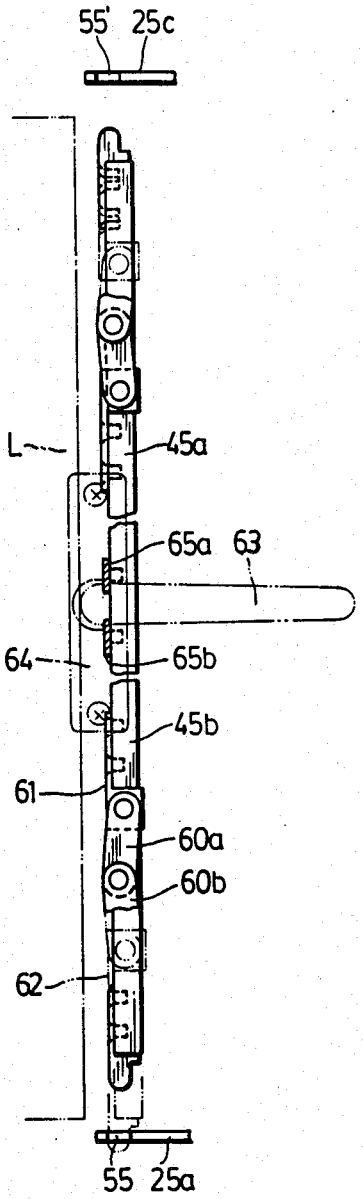

Referring to FIGS. 11 and 12, if the lever handle 63 is rotated in clockwise direction, the levers 65*a* and 65*b* are slid towards each other so that the locking rods 45*a* and 45*b* are moved to let the terminals 59 disengage from the terminal receiving holes 55 and 55' respectively. In this case, the linkarms 60*a*, 60*b* are stretched and no longer abut against the combined edge member 43, as shown in FIG. 14. Then the coil spring 56 will be at a left hand bias with the sliding member 25*b* so that the right sash piece R is moved to the left a predetermined distance 1.

Figure 10:
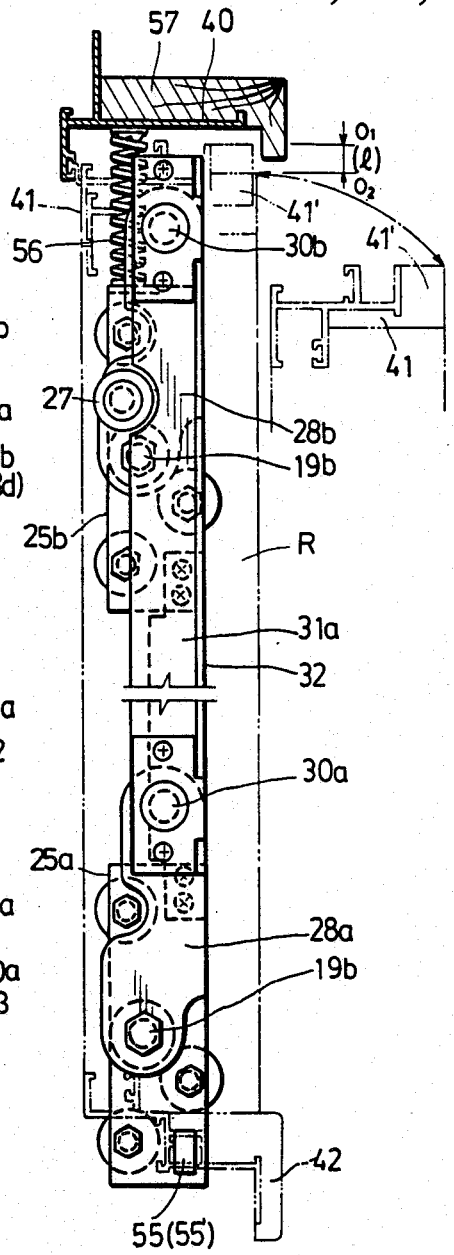

Now, the guide roller 27 abuts against the edge of the projecting plate 18 as shown in FIG. 15 to prevent the right sash piece R from moving beyond the distance 1. The sash piece R is ready to be pulled to the left through the movements of the linkarms. When the lever handle 63 is pulled inwards the sash piece R will move towards the room along the moving trace as shown in FIGS. 9 and 10. Then, the right sash piece R can be moved to the left, while the left sash piece L can be moved to the right.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modification and equivalent structures.

What is claimed is:

1. A lateral sliding sash comprising: a sash frame having an upper and a lower frame member and two upright frame members;

a first sash piece slidably mounted on said sash frame;

a second sash piece;

two sets of sliding members slidably mounted on said lower and upper frame members, respectively, said sliding members of each set being separated a predetermined distance and capable of being moved together; and two sets of linkarms pivotally connected to said sets of sliding members at their one ends, and to the lower and upper surfaces of said second sash piece at their other ends, respectively, said linkarms of each set being in parallel to each other, so that said second sash piece can be pushed to engage in said sash frame and in alignment with said first sash piece, and can be pulled to disengage from said sash frame by the movements of said sets of linkarms and slid laterally with said sets of sliding members along said lower and upper frame members.

2. A lateral sliding sash as claimed in claim 1, wherein said lower and upper frame members have respective receiving chambers for slidably receiving said sliding members therein; said lower frame member has a projecting plate extending downwards and having a recess; and said lateral sliding sash further comprises a guide roller rotatably secured on one of said linkarms, when said second sash piece is disengaged from said sash frame and moved laterally, said guide roller is rolled along one side of said projecting plate and provides an inhibition for said second sash piece from returning back by itself, whereas when said second sash piece is in a predetermined position ready to engage in said sash frame, said guide roller is moved into said recess by said linkarm, so that the return inhibition is released.

3. A lateral sliding sash as claimed in claim 1, further comprising a coil spring secured to one of said upright frame members at its one end, and wherein one of said sliding members has a downward flange for touching the other end of said coil spring when said second sash piece is moved to a predetermined position ready to engage in said sash frame, and when said second sash piece is further pushed, said coil spring first limiting the lateral movement of said second sash piece in order to begin the linkarm movement of said second sash piece, and then being compressed when said second sash piece is fully engaged in said sash frame.

4. A lateral sliding sash as claimed in claim 1, further comprising a locking device, which includes a lever handle rotatably mounted on said second sash piece, and two locking rods slidably mounted on said second sash piece, associated with said lever handle respectively, and capable of being urged to insert into two receiving holes respectively on two of said sliding members by said lever handle to lock said lateral sliding sash.

* * * * *